United States Patent [19]

Ishikawa

[11] Patent Number: 4,654,898

[45] Date of Patent: Apr. 7, 1987

[54] REMOVABLE EAR MUFF FOR HEADPHONES

[76] Inventor: Gerald K. Ishikawa, 1613-D W. Greenleaf, Chicago, Ill. 60626

[21] Appl. No.: 786,507

[22] Filed: Oct. 11, 1985

[51] Int. Cl.[4] ..... A41D 21/00

[52] U.S. Cl. ..... 2/209; 381/187

[58] Field of Search ..... 2/209, 6, 423; 179/156 R, 156 A, 182 R, 184, 182 A

[56] References Cited

U.S. PATENT DOCUMENTS 3,823,713 7/1974 Shah ..... 2/209 X 4,546,215 10/1985 Ferraro ..... 179/156 R

FOREIGN PATENT DOCUMENTS 2538204 6/1984 France ..... 179/156 R

OTHER PUBLICATIONS

Gershman, "Self Adhering Nylon Tapes", vol. 68, No. 7—J.A.M.A.—10/18/58.

*Primary Examiner*—Peter Nerbun

*Attorney, Agent, or Firm*—Glenn W. Bowen

[57] ABSTRACT

The present invention relates in general to ear muffs and in particular to an ear muff for headphones for portable radios and cassette players and the like, which may be easily removed or exchanged. The ear muff is constructed with a support cup that is covered by fabric, wool or other material which engages, and at least partially surrounds the ear of the wearer to keep it warm in cold weather. The band or strap for the headphone speaker is captured by two overlapping flaps that extend over the band or strap which are preferably locked together by mating plastic loop and hook type fasteners.

6 Claims, 4 Drawing Figures

REMOVABLE EAR MUFF FOR HEADPHONES

BACKGROUND OF THE INVENTION

Portable radios and cassette players with small speakers that are held adjacent the ears of the listener by a headband have become very popular in recent years. These speakers are commonly much smaller in diameter than the outer extremities of the listener's ears, and consequently, the outdoor use of these devices is virtually abandoned in the wintertime in cold climates due to the necessity of protecting the ears from frostbite and the discomforts of cold weather.

Large cavity headband supported ear protection devices are known which encompass much of the ears of the user. Similarly, large cavity headphones have been used for reception of audio. However, these types of devices are too bulky and expensive to be practically adapted for use with the aforementioned relatively inexpensive and small portable listening machines that have achieved such widespread useage. Likewise, the placement of a conventional second headband carried ear muff over the earpiece or speaker of the headphone is awkward, unsightly and often relatively ineffective.

The present invention is directed to an ear protection muff which allows the owners of portable listening machines with conventional lightweight headphones the opportunity of listening to their machines outdoors the year around.

SUMMARY OF THE INVENTI0N

The present invention is directed to an ear muff which is used to protect the ears of a listener who is listening to a headband-supported speaker which is smaller than the outer extremities of the ear. The muff has a cup section that is larger than the speaker, and is covered by material that overlaps the protected ear. The muff has a pair of overlapping flaps which envelop the speaker, the lower end of the headband which is secured to the speaker, and at least part of the ear of the wearer. The flaps are preferably removably attached to each other, such as by removable hook and loop plastic fastener straps.

BRIEF DESCRIPTION OF THE DRAWINGS

The present invention is illustrated by reference to the drawings in which.

DESCRIPTION OF THE INVENTION

An embodiment of the present invention is described by reference of FIGS. 1–4 which show the ear muff 10 of the invention as applied over the lower end of a headband for a portable listening device. The muff may also be used in conjunction with conventional headband-supported ear muffs to provide designer ear muffs which may be changed to match the clothes of the wearer. The muff may also be used as a novelty item which can be decorated with special emblems, such as football team logos, and distributed as promotional gifts.

Figure 1:
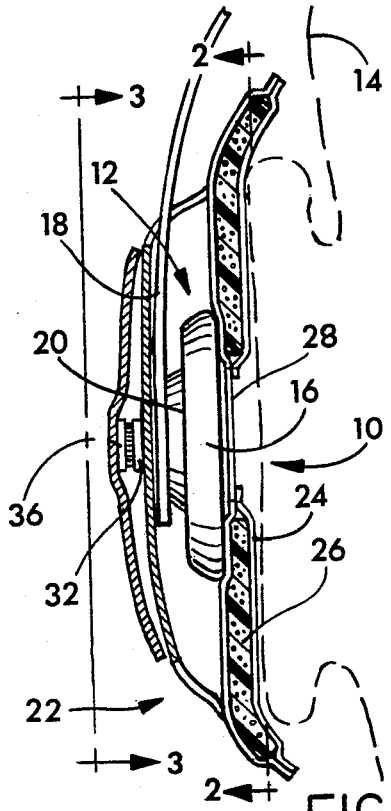
FIG. 1 shows a side cross-sectional view of an ear muff constructed in accordance with the present invention.

Referring to FIG. 1, the muff 10 is shown with an open pocket 12 which allows for protection of the ear 14 of the wearer from the cold, and at the same time enables the wearer to listen to audio broadcasts or recordings through a speaker 16. The speaker is located on the lower of the headband 18 in the earpiece 20.

The outboard flap portion 22 of the muff 10 is pulled away from the cover 24, which contacts the ear, to form the pocket 12 which receives the earpiece 20. The cover 24 encloses a support structure 26. The support structure 26 may be formed of a resilient or elastomeric material such as rubber, or it may alternately be formed of plastic or other suitable material.

Figure 2:
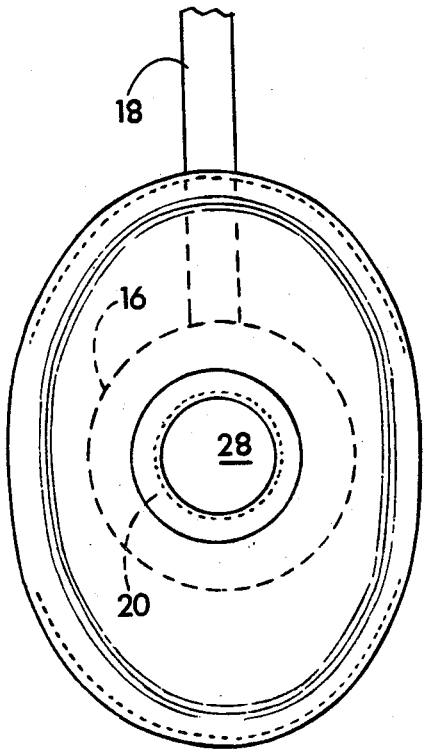
FIG. 2 is a view looking toward the ear muff of FIG. 1 from the ear of the user along the lines 2—2 of FIG. 1.
Figure 3:
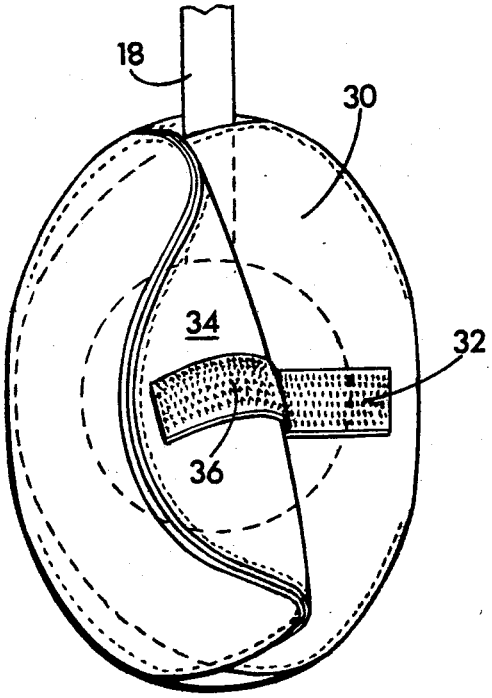
FIG. 3 is a view looking toward the ear of the user along the lines 3—3 of FIG. 1.
Figure 4:
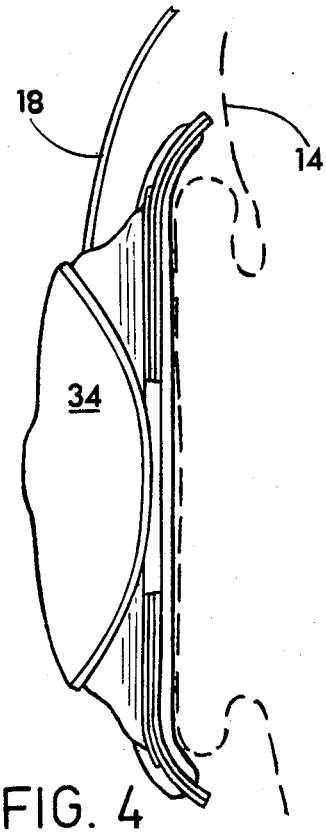
FIG. 4 is a side view of the ear muff of the present invention.

The support structure may be curved at its extreme ends so as to bend over and cover the ear tips as shown in FIG. 2. The ends of the support-structure 26 could be formed so they merely engage the ear and do not cup over the ear tips, if desired. The support structure preferably is formed with a central opening over the speaker area so as to allow the maximum amount of sound to be transmitted from the earpiece to the ear. The opening is desirably covered by a thin layer 28 of material.

An inner flap 30 and an overlapping outer flap 34 are pulled over the lower end of the headband 18 of the earpiece 20. The outer surace of the inner flap 30 preferably has one element strip 32 of a suitable two element fastener, such as those formed of facing loop and mating hook materials which are sold under the trademark Velcro. The mating element strip 36 is fastened to the inner surface of the outer flap 34. Other types of suitable fasteners may be employed, if desired, when the fastener strips 32,36 are closed they securely hold the muff on the earpiece speaker; or over the earpiece of a conventional ear muff as an alternative embodiment.

What is claimed is:

1. An ear muff comprising a cover having an ear engaging member, inner and outer flaps secured to said member to form a pocket between said member and said flaps, said pocket is capable of opening so as to receive therein the lower end of a headband and an earpiece attached thereto wherein said ear muff is constructed so that both of said flaps overlap said headband and said earpiece, so as to close said pocket with said headband and said earpiece therein with said earpiece aligned with the ear of the wearer, and fastener means associated with said flaps so that said flaps are releasably securable over said headband and said earpiece.

2. An ear muff as claimed in claim 1 wherein said fastener means comprises mating plastic loop and hook fastener strips secured respectively on facing overlapping surfaces of said flaps.

3. An ear muff as claimed in claim 1 comprising cover means and a support structure wherein said cover means encloses said support structure and said support structure has a central opening aligned with the input channel of the ear of the wearer.

4. An ear muff as claimed in claim 3 wherein said fastener means comprises mating plastic loop and hook fastener strips secured respectively on facing overlapping surfaces of said flaps.

5. An ear muff as claimed in claim 3 wherein said support structure is shaped to at least partly cover the ear tips of the ear of the wearer.

6. An ear muff as claimed in claim 5 wherein said fastener means comprises mating plastic loop and hook fastener strips secured respectively on facing overlapping surfaces of said flaps.

* * * * *